US007568455B2

(12) United States Patent
Giovanardi et al.

(10) Patent No.: US 7,568,455 B2
(45) Date of Patent: Aug. 4, 2009

(54) METHOD AND DEVICE FOR CONTROLLING AN ELECTRODYNAMIC BRAKE OF AN ELECTRIC CAMSHAFT ADJUSTER FOR AN INTERNAL COMBUSTION ENGINE

(75) Inventors: Lorenzo Giovanardi, Florence (DE); Matthias Gregor, Stuttgart (DE); Jens Meintschel, Esslingen (DE); Reinhard Orthmann, Leonberg (DE); Bernd-Heinrich Schmitfranz, Esslingen (DE); Markus Stalitza, Schwäbisch Gmünd (DE)

(73) Assignee: Daimler AG, Stuttgart (DE)

( * ) Notice: Subject to any disclaimer, the term of this patent is extended or adjusted under 35 U.S.C. 154(b) by 116 days.

(21) Appl. No.: 11/821,549

(22) Filed: Jun. 22, 2007

(65) Prior Publication Data

US 2008/0029051 A1 Feb. 7, 2008

Related U.S. Application Data

(63) Continuation-in-part of application No. PCT/EP2005/013269, filed on Dec. 10, 2005.

(30) Foreign Application Priority Data

Dec. 24, 2004 (DE) ..... 10 2004 062 499
Apr. 7, 2005 (DE) ..... 10 2005 015 856

(51) Int. Cl.
*F01L 1/34* (2006.01)

(52) U.S. Cl. ..... 123/90.15; 123/90.17; 361/139

(58) Field of Classification Search ..... 123/90.15, 123/90.16, 90.17, 90.18, 90.11; 310/77, 310/93; 361/139
See application file for complete search history.

(56) References Cited

U.S. PATENT DOCUMENTS

| | | | | |
|---|---|---|---|---|
| 5,218,935 | A | 6/1993 | Quinn, Jr. et al. | |
| 7,380,529 | B2 * | 6/2008 | Finis et al. | 123/90.15 |

FOREIGN PATENT DOCUMENTS

| | | |
|---|---|---|
| DE | 100 38 354 | 2/2002 |
| DE | 102 47 650 | 4/2003 |
| DE | 102 42 659 | 3/2004 |
| DE | 102 51 347 | 3/2004 |
| DE | 102 59 134 | 7/2004 |
| WO | WO 2004/007919 | 1/2004 |
| WO | WO 2004/057161 | 7/2004 |

* cited by examiner

*Primary Examiner*—Ching Chang
(74) *Attorney, Agent, or Firm*—Klaus J. Bach

(57) ABSTRACT

In a method and device for adjusting an electro-dynamic brake of an electric camshaft adjuster for a phase angle adjustment of a camshaft of an internal combustion engine with respect to the crankshaft thereof, the phase angle is controlled by means of a position controller and the adjustment speed of the phase angle of the camshaft with respect to the crankshaft is controlled by means of an adjustment speed controller by controlling the current through the electro-dynamic brake by means of a further adjustment device and the use of Pilot controls to improve the control behavior of the cascade controller.

10 Claims, 2 Drawing Sheets

METHOD AND DEVICE FOR CONTROLLING AN ELECTRODYNAMIC BRAKE OF AN ELECTRIC CAMSHAFT ADJUSTER FOR AN INTERNAL COMBUSTION ENGINE

This is a Continuation-In-Part Application of pending International Patent Application PCT/EP2005/013269 filed Dec. 10, 2005 and claiming the priority of German Patent Applications 10 2004 062 499.2 filed Dec. 24, 2004 and 10 2005 015 856.0 filed Apr. 7, 2005.

BACKGROUND OF THE INVENTION

The invention relates to a method for operating a device for controlling an electrodynamic brake of an electric camshaft adjuster for an internal combustion engine wherein, in a cascade control, the phase position of the camshaft adjuster is controlled by a position controller and the phase angle is controlled by an adjustment speed controller.

The phase angle of a camshaft with respect to a crankshaft of an internal combustion engine can be changed by passive (driveless) camshaft adjusters. These camshaft adjusters comprise, for example, a brake and a summing gear (DE 100 38 354 A1) or a brake and a lever mechanism (DE 102 47 650 A1), wherein the lever mechanism acts like a summing gear. Generally, hysteresis brakes which are contactless and operate without wear are used as the brakes.

In order to maintain and adjust the phase angle, a controller is necessary since it is the variable torque of the brake at the actuating input of the summing gear, i.e. at the actuating shaft, which brings about changes in the phase angle of the camshaft. Applying the brake slows down the actuating shaft and thus changes the phase angle by means of the summing gear, and, with a negative gear mechanism as the summing gear, the phase angle is adjusted in the advance direction.

If the brake is released, the actuating input accelerates due to the load torque of the camshaft and the phase angle is adjusted in the retarding direction if a negative gear mechanism is used. If the phase angle is to be constant, a coupling situation needs to be established in which there is no relative movement in the gear mechanism, that is, the actuating shaft must be held at the camshaft rotational speed.

A control structure for the adjustment motor of an electric camshaft adjuster according to the prior art is known, for example, from German laid-open application DE 102 51 347 A1. A control structure for reaching the setpoint adjustment rotational speed of an adjustment motor for the electric camshaft adjuster is described in said document, wherein the camshaft adjuster includes at least one controller which generates control signals for the adjustment motor from measurement signals of the internal combustion engine.

The controller has a differential signal composed of setpoint values and actual values as the input signal, and a regulated setpoint adjustment rotational speed, which is intended for the adjustment motor and to which a nonregulated rotational speed signal is added, as the output signal. Different embodiments of a position controller, a rotational speed controller, a combined position and rotational speed controller and a two-point current controller as an example of a current limiting function are proposed.

It is the principal object of the present invention to further improve the control behavior of a control structure or the control structure of a camshaft adjuster of an internal combustion engine.

SUMMARY OF THE INVENTION

In a method and device for adjusting an electro-dynamic brake of an electric camshaft adjuster for a phase angle adjustment of a camshaft of an internal combustion engine with respect to the crankshaft thereof, the phase angle is controlled by means of a position controller and the adjustment speed of the phase angle of the camshaft with respect to the crankshaft is controlled by means of an adjustment speed controller by controlling the current through the electro-dynamic brake by means of a further adjustment device and the use of pilot controls to improve the control behavior of the cascade controller.

The advantages of the invention reside in the fact that the pilot controls significantly improve the control behavior of the cascade controller and increase the control quality, as a result of which a more rapid and more precise adjustment of the phase angle of the camshaft is possible. This in turn permits improved operation of the internal combustion engine adapted to the respective load situation, so that the consumption is reduced, wear is decreased and oscillations and resulting damage and losses of comfort are avoided.

For the purpose of pilot control, the crankshaft rotational speed is taken into account as an additional characteristic variable in the cascade controller or rather in the current adjustment device. A signal representing the rotational speed of the crankshaft is almost always available in the (engine) control device so that there is no need for an additional sensor, an additional signal on the (CAN) bus or an additional interrogation in the software. There are various ways in which this variable can advantageously be taken into account.

The advantages of taking into account the rotational speed of the crankshaft by means of a pilot control in the cascade controller are generally more rapid and more precise adjustment of the phase angle of the camshaft and thus also of the entire internal combustion engine, with the already mentioned positive effects.

Finally, in an advantageous embodiment of the invention the current through the hysteresis brake is adjusted by means of a model-based actual value estimator with an observer.

Simply adjusting the current by means of a controller already significantly improves the control behavior of the cascade controller, and thus the adjustment of the phase angle of the camshaft, with all the resulting advantages which have already been mentioned. A model-based actual value estimator with an observer allows the excellent control behavior of the control structure to be maintained in its entirety, and furthermore there is a reduction in cost since a current sensor can be eliminated and expenditure and costs can thus be made significantly lower.

The invention will become more readily apparent from the following description of an exemplary embodiment with reference to the accompanying drawings:

DESCRIPTION OF A PARTICULAR EMBODIMENT OF THE INVENTION

The invention is suitable in particular for an electro-dynamic brake of an electric camshaft adjuster of a camshaft of an internal combustion engine.

Figure 1:
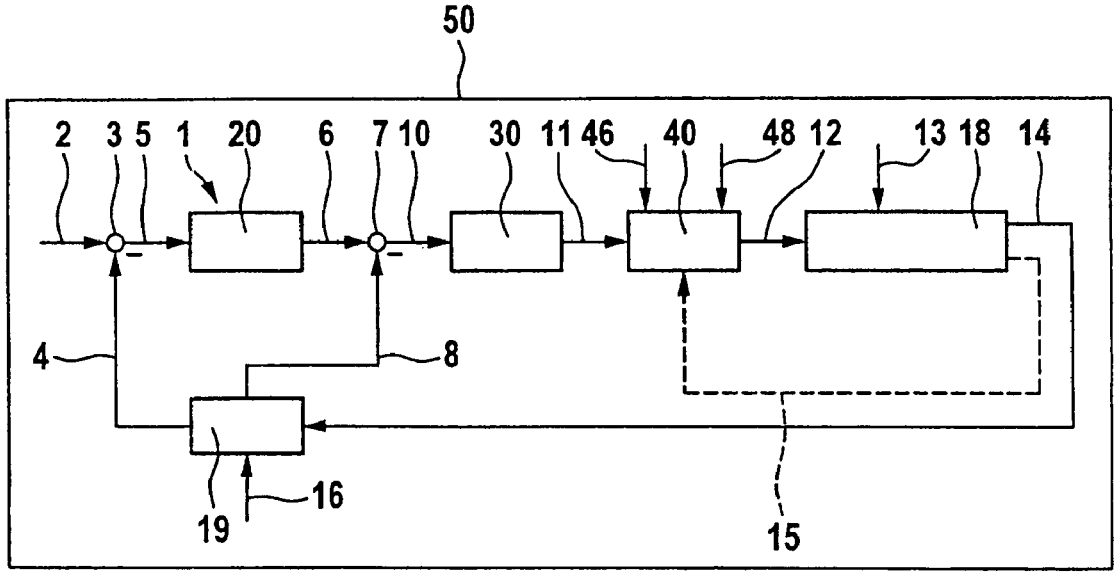
FIG. 1 is a basic illustration of a cascade controller for an electro-dynamic brake of an electric camshaft adjuster.

FIG. 1 shows a cascade controller 1 for an electro-dynamic brake (not illustrated in detail)—with a rotor—of an electric camshaft adjuster, having a position controller 20 for adjusting the phase angle, an adjustment speed controller 30 for setting the adjustment speed of the phase angle, a current adjustment device (40), which is an open-loop or closed-loop controller and with which the current through the electro-dynamic brake is adjusted, a control arrangement 18—which includes an actuation electronic system, an electro-dynamic brake with a highly nonlinear current/torque characteristic curve, an actuating gear and a camshaft—and a position sensing unit 19. The cascade controller 1 is usually part of a (engine) control device 50. The setpoint variable 2 of the cascade controller 1 is a variable $\Delta\theta_{desired}$ which is concerned with a change in the phase angle of the camshaft with respect to the crankshaft.

In a summing element 3, an actual variable 4, representing an actual phase angle $\Delta\theta_{actual}$ is subtracted from the setpoint variable 2, which yields a control error 5 that is supplied to the position controller 20 as an input variable. The output variable of the position controller 20 is a control variable 6 (setpoint adjustment speed of a phase angle $\Delta\omega_{desired}$) which is fed to a further summing element 7 and from which a setpoint variable 8 is subtracted in the summing element 7. The setpoint variable 8 which is supplied by the position sensing unit 19 is an actual adjustment speed of the phase angle $\Delta\omega_{ist}$. A control error 10 is thus fed to the adjustment speed controller 30.

The output variable 11 of the adjustment speed controller 30 is a torque control signal which is fed as an input variable to the current adjustment device 40. In addition, a variable 46 which represents the rotational speed of the crankshaft (n-KW) is also fed to the current adjustment device 40 as well as a variable 48 which represents the rotation brake of the electro-dynamic brake (or of its rotor); the variable 46 (n-KW) is usually available within the (engine) control device 50, and the variable 48 (brake) is calculated in the position sensing unit19. The output variable 12 of the current adjustment device 40 is a voltage $U_a$ which is fed to the actuation unit for the brake within the controlled arrangement 18. The torque of the camshaft ($M_{NW}$) acts as an interface variable 14 of the controlled system 18 is a (measurement) variable $\theta_{adjuster}$ (position of the brake) or $\theta_{NW}$ (position of the camshaft) depending on the sensor system used.

The current adjustment device 40 can be an open-loop or closed-loop controller. If it is a closed-loop controller, a second output variable 15, which is concerned with the current $i_{adjuster}$ for the brake, is obtained at the output of the controlled system 18 and fed to the current adjustment device 40.

The output variable 14 ($\theta_{adjuster}$, i.e. the position of the brake or $\theta_{NW}$, i.e. the position of the camshaft) of the controlled system 18 is fed to the position sensing unit 19; furthermore, as a further variable the position of the crankshaft is fed as a variable 16 ($\theta_{KW}$) to the position sensing unit 19.

If the output variable 14 is $\theta_{adjsuter}$ (position of the brake), the position $\theta_{NW}$ (position of the camshaft) is calculated in the position sensing unit 19 using $\theta_{KW}$ (position of the crankshaft). A rotational speed of the camshaft $n_{NW}$ and the rotational speed of the crankshaft $n_{KW}$ are calculated in the position sensing unit 19 from the change in the respective positions over time. The output variable 4 is the actual phase angle $\theta_{actual}=\theta_{NW}-\theta_{KW}/2$ of the camshaft with respect to the crankshaft.

The output variable 8 is the actual adjustment speed $\Delta\omega_{actual}=n_{NW}-n_{KW}/2$ of the camshaft with respect to the crankshaft. The adjustment speed controller 30 thus adjusts the rotational speed of the brake (w-brake) when the position controller 20 is inactive (control variable 6 is 0) to a camshaft rotational speed n-NW, and thus sets the adjustment speed 0. The position controller 20 is thus advantageously relieved of loading, its function is only to set an additional adjustment angle and not to maintain the phase angle.

Figure 2:
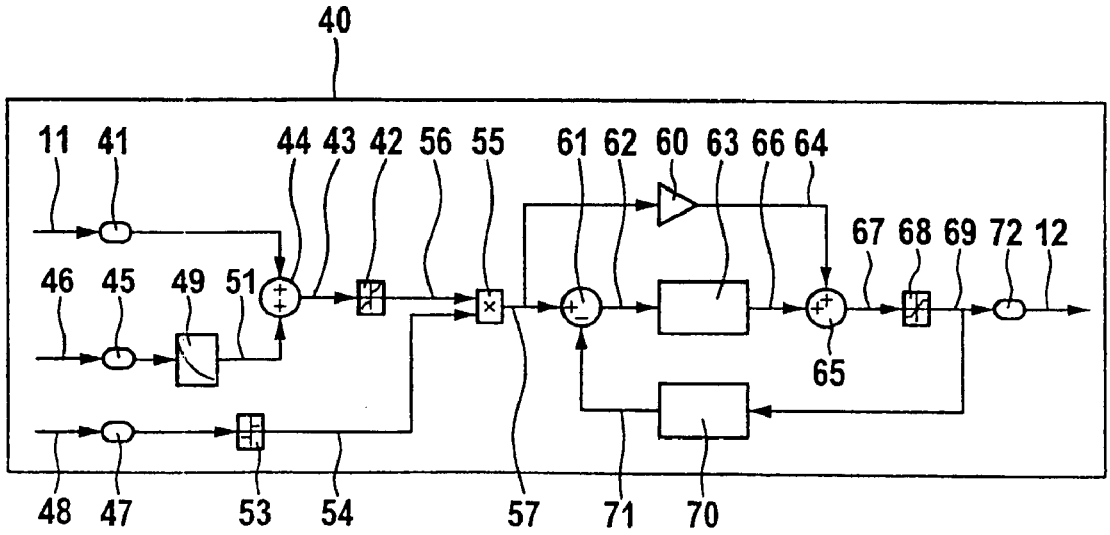
FIG. 2 is a basic illustration of an embodiment of the current adjustment device of the camshaft adjuster.

FIG. 2 illustrates in principle an embodiment of the current adjustment device 40 from FIG. 1. The current adjustment device 40 is an open-loop or closed-loop controller; in the present exemplary embodiment a controller (actual value estimator with an observer) is used.

The output variable 11 of the adjustment speed controller 30 (FIG. 1), the torque M_controller, is fed to the current adjustment device 40 as an input variable to a first input 41 and then as a first input signal (11) to a summing element 44. In order to perform pilot control to improve the control behavior, a variable 46, which represents the rotational speed of the crankshaft (n-KW) is fed to the current adjustment device 40 via a second input 45. The rotational speed of the crankshaft (n KW) 46 is converted into a second torque (M-pilot) signal 51 by means of a rotational-speed-dependent characteristic curve 49 in which the central load torque of the electro-dynamic brake is stored, for example, in the form of a value table. This torque (M-pilot) signal 51 is then likewise fed to the summing element 44 as a second input signal. The sum formed in the summing element 44 from the first torque (M-controller) 11 and the second torque (M-pilot) 51 yields a setpoint torque signal (M-desired) 43.

This pilot control has the purpose of bringing about an overall improvement in the control behavior of the cascade controller 1 (FIG. 1). When a constant phase angle is being held, the electro-dynamic brake must compensate the central load torque of the camshaft and of the connected assemblies divided by the transmission ratio of the gear. This load torque is known; it is taken into account in the form of the second torque (M-pilot) 51 and is subsequently added to the first torque (M-controller) 11, which then yields the setpoint torque (M-desired) 43.

The setpoint torque signal (M-desired) 43 is converted into a current (I-desired) 56 by means of an inverted current/torque characteristic curve 42 of the electro-dynamic brake, which is stored, for example, as a value table in the current adjustment device 40, and this current (I-desired) 56 is fed to a multiplier 55.

Figure 3:
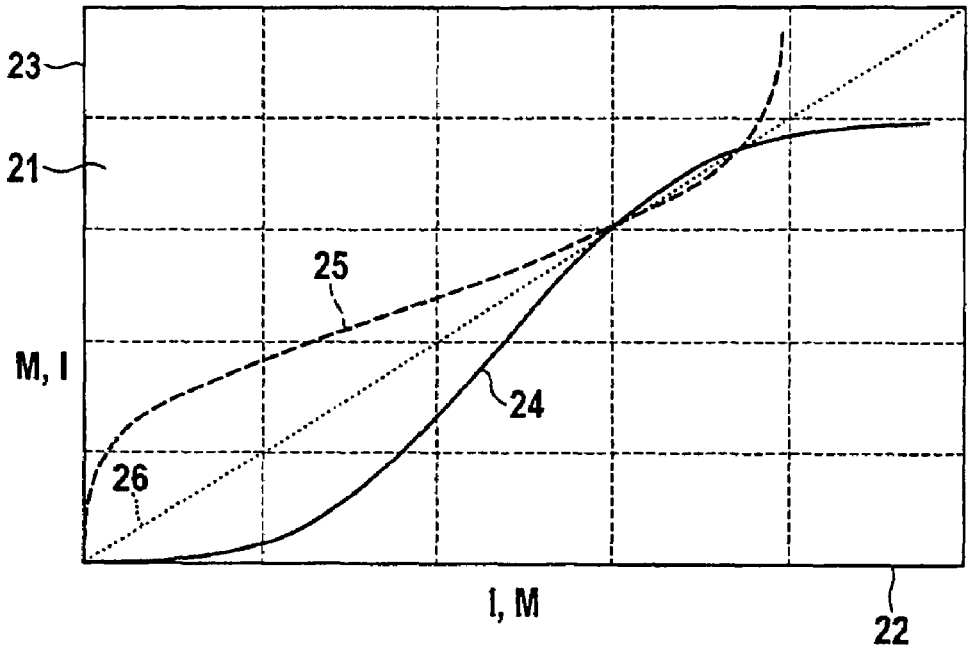
FIG. 3 shows the highly nonlinear current/torque characteristic curve of the electro-dynamic brake, the associated inverted characteristic curve which is used in the controller and the linearization which results from the series connection.

The inverted current/torque characteristic curve 42 has the purpose of bringing about an overall improvement in the control behavior of the cascade controller 1 (FIG. 1) by compensating for the highly nonlinear current/torque characteristic curve of the brake (contained in the controlled system 18). For the entire control circuit 1 this corresponds to a series connection (multiplication) of the nonlinear electro-dynamic brake to its inverted characteristic curve so that the nonlinear effect of the brake is canceled out (FIG. 3).

The variable 48, which is concerned with the rotation (w-brake) of the electro-dynamic brake (or of its rotor) is also fed to the current adjustment device 40 via a third input 47. This variable (w-brake) 48 is fed to a sign block 53 whose output signal 54 has, for example depending on the direction of rotation of the brake in the form of the variable (w-brake) 48 a positive or negative absolute value (or zero if the brake is not rotating, i.e. when the internal combustion engine is not activated). The output signal 54 of the sign block 53 is fed as a second variable to the multiplier 55, as is the current (I-desired) 56.

In the multiplier 55, the current (I-desired) 56 is multiplied by the sign which is obtained from the signal 54, and the direction of rotation of the electro-dynamic brake is thus also included in the cascade controller 1, which means that, for example when there is a negative direction of rotation of the electro-dynamic brake, a reversal of sign takes place. A current 57 (with a positive or negative sign or no current if the internal combustion engine is not activated) is obtained from this multiplication as an output signal of the multiplier 55, said current being fed to a downstream summing element 61 with an output signal 62.

By means of the multiplier 55, a nonlinearity of the electro-dynamic brake is taken into account by restricting the actuator system to the braking mode. The electro-dynamic brake which is used as an actuator can only brake and not drive. If the adjustment speed controller 30 (FIG. 1) outputs a change of sign of the torque (M-controller) 11 (FIG. 1) or of the setpoint current 15 (FIG. 1), it also anticipates a change in sign of the direction of the torque. However, the electro-dynamic brake always generates a braking torque, independently of the direction of current ($M_{Brake}(I)=M_{Brake}(-I)$).

For this reason, the torque (M-controller) 11 or the setpoint current 15 is limited to values which are greater than or equal to zero ($\geqq 0$) (in this case positive current signifies braking mode), and negative values are set to zero. Depending on the sign convention the reversal is equally possible in the controller 1 (limitation to values less than or equal to zero ($\leqq 0$), and in this case negative current signifies braking mode).

Figure 4:
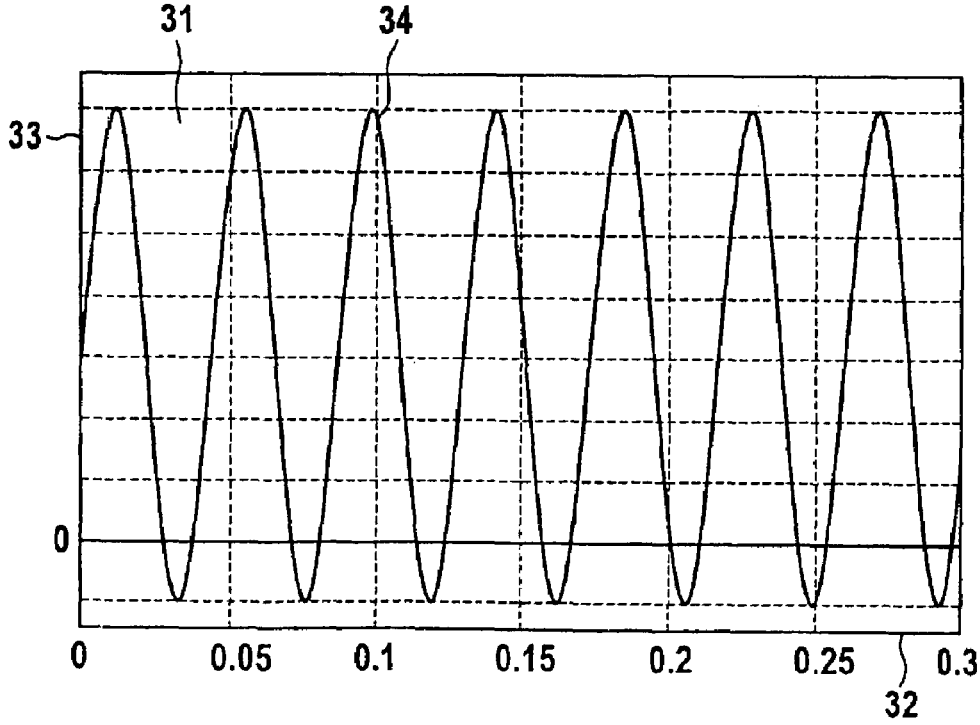
FIG. 4 shows the brief reversal of the direction of rotation of the rotor of the electro-dynamic brake at low rotational speeds of the internal combustion engine, caused by the alternating torques to which the camshaft is subjected.

At low rotational speeds of the internal combustion engine, the alternating torques of the camshaft can bring about a brief reversal of the direction of rotation of the rotor of the brake (see FIG. 4). Braking with a reversed direction of rotation of the rotor also generates a reversal of the direction of adjustment. That is to say the controller 1 would thus be unstable, and a setpoint adjustment signal in one direction would trigger an adjustment process in the opposite direction. The problem is solved by multiplying the current (I-desired) 56 or the torque (M-controller) 11 by the sign 54 of the rotational speed of the rotor in the multiplier 55.

The current 57 as an output signal of the multiplier 55 is fed, on the one hand, to a further pilot control 60 with an output signal (U-stat) 64 whose purpose will be explained below, and on the other hand to the summing element 61, which serves to form a control error 62 for a further current adjustment device 63, the actual one, which has an output signal (U-dyn) 66.

In the further pilot control 60, the current 57 is multiplied by the ohmic resistance of the coil of the brake. The output signal (U-stat) 64 is added to the output signal (U-dyn) 66 of the further and actual current adjustment device 63 by means of a further summing element 65, which has an output signal (U-out) 67, in order to optimize the control behavior.

The output signal (U-out) 67 of the further summing element 65 is fed to a voltage limiter 68 with an output signal 69, and the output signal 69 is in turn fed, on the one hand, to a current estimation device (observer) 70 with an output signal (i-est) 71 and, on the other hand, to an output 72 as output signal ($U_a$) 12 ($U_a$ corresponds to U-out).

The output signal (i-est) 71 of the current estimation device 70 is fed to the summing element 61 and subtracted there from the signal 57, which then yields the input signal 62 for the current adjustment device 63.

The current adjustment in the current adjustment device 63 is carried out by means of a model-based actual value estimator with the current estimation device 70 as observer. A current sensor for measuring the current through the electro-dynamic brake and the looping back of the associated measured value to the setpoint actual value comparison means are thus dispensed with. The observer 70 observes the profile of the signal (U-out=$U_a$) 69, models the voltage/time behavior of the electro-dynamic brake over time and ideally also takes into account the temperature properties, for example change in electrical resistance (temperature compensation).

FIG. 3 shows, in a diagram 21, an x axis 22, a y axis 23 and three curves 24, 25 and 26. Curve 24 is a highly nonlinear current/torque characteristic curve 24 M=f(I) of the electro-dynamic brake with the current I as the x axis 22 and the torque M as the y axis 23. The curve 25 shows the associated inverted characteristic curve I=f(M) which is used in the current adjustment device 40 (FIGS. 1, 2) and has the torque M as the x axis 22 and the current I as the y axis 23. The curve 26 is the linearization which is obtained by the combination of the characteristic curve 24 of the brake and the inverted characteristic curve 25 which is used in the controller.

FIG. 4 shows a time axis 32 and an axis 33 for the rotational speed in a diagram 31 and the chronological profile of the rotor of the electro-dynamic brake in a curve 34.

The brief reversal of the direction of rotation of the rotor of the electro-dynamic brake at low rotational speeds of the internal combustion engine, brought about by the alternating torques of the camshaft, can be seen on the curve 34. This reversal of the direction of rotation occurs when the curve 34 extends below the zero line.

What is claimed is:

1. A method for operating a device for controlling an electro-dynamic brake of an electric camshaft adjuster for a phase angle adjustment of a camshaft relative to a crankshaft of an internal combustion engine, comprising the steps of:

controlling within a cascade controller (1), a phase position of the camshaft with respect to the crankshaft by means of a position controller (20), and the adjustment speed of the phase angle of the camshaft with respect to the crankshaft by means of an adjustment speed controller (30), adjusting a current (15) through the electro-dynamic brake by means of a further adjustment device (40), and using pilot controls to improve the control behavior of the cascade controller (1).

2. The method as claimed in claim 1, wherein an input signal (11) representing a first torque value (M-controller) of the electro-dynamic brake is supplied as a first characteristic variable to the further adjustment device (40) by a control device (50).

3. The method as claimed in claim 2, wherein a second characteristic variable (n-KW, 46) is supplied to the further adjustment device (40).

4. The method as claimed in claim 3, wherein a crankshaft rotational speed (n-KW) signal is supplied as the second characteristic variable (46) to the further adjustment device (40).

5. The method as claimed in claim 4, wherein in the further adjustment device (40) the crankshaft rotational speed (n-KW) 46 is converted into a second torque signal (M-pilot, 51) by means of a torque/rotational speed characteristic curve (49), which is stored in the further adjustment device (40) for the electro-dynamic brake.

6. The method as claimed in claim 5, wherein the first torque input signal (M-controller, 11) and a second torque input signal (M-pilot, 51) are added in a summing element (44) to form a setpoint torque signal (M-desired, 43).

7. The method as claimed in claim 6, wherein the set point torque signal (M-desired, 43) is converted into a current signal (I-desired, 56) by means of an inverted current/torque characteristic curve (42) of the electro-dynamic brake.

8. The method as claimed in claim 1, wherein the actual adjustment speed (8) of the phase angle for determining a control error (10) of a speed controller (30) is determined from the difference between the camshaft rotational speed and half the crankshaft rotational speed of the internal combustion engine.

9. The method as claimed in claim 1, wherein the current through the electro-dynamic brake is adjusted by means of a model-based actual value estimator (63) with an observer (70).

10. A device for adjusting an electro-dynamic brake of an electric camshaft adjuster for a phase angle adjustment of a camshaft with respect to a crankshaft of an internal combustion engine, said device comprising a cascade controller (1), including a position controller (20) for controlling the phase angle of the camshaft with respect to the crankshaft, and an adjustment speed controller (30) for controlling the adjustment speed of the phase angle, a further adjustment device (40) for adjusting a current (15) through the electro-dynamic brake, and a device for improving the control behavior of the cascade controller (1) provided with pilot controls.

* * * * *